US010100640B2

(12) United States Patent
Yamashita et al.

(10) Patent No.: US 10,100,640 B2
(45) Date of Patent: Oct. 16, 2018

(54) ELECTRIC COMPRESSOR FOR VEHICLE AIR CONDITIONER

(71) Applicant: KABUSHIKI KAISHA TOYOTA JIDOSHOKKI, Kariya-shi, Aichi-ken (JP)

(72) Inventors: Takuro Yamashita, Aichi-ken (JP); Tomoyoshi Inagaki, Aichi-ken (JP)

(73) Assignee: KABUSHIKI KAISHA TOYOTA JIDOSHOKKI, Aichi-ken (JP)

( * ) Notice: Subject to any disclaimer, the term of this patent is extended or adjusted under 35 U.S.C. 154(b) by 432 days.

(21) Appl. No.: 14/553,128

(22) Filed: Nov. 25, 2014

(65) Prior Publication Data

US 2015/0147205 A1 May 28, 2015

(30) Foreign Application Priority Data

Nov. 28, 2013 (JP) ..... 2013-246585

(51) Int. Cl.
*F01C 21/00* (2006.01)
*F04B 39/14* (2006.01)
(Continued)

(52) U.S. Cl.
CPC ..... *F01C 21/007* (2013.01); *F04B 35/04* (2013.01); *F04B 39/121* (2013.01); *F04B 39/14* (2013.01);
(Continued)

(58) Field of Classification Search
CPC ..... F01C 21/007; F04B 39/121; F04B 39/14; F04B 35/04; F04B 53/16; F04C 23/008;
(Continued)

(56) References Cited

U.S. PATENT DOCUMENTS 8,777,593 B2 7/2014 Kinoshita et al.
2010/0226800 A1* 9/2010 Ichise ..... B60H 1/00978 417/410.5
(Continued)

FOREIGN PATENT DOCUMENTS

JP 2004-324494 A 11/2004
JP 2009-085082 A 4/2009
(Continued)

*Primary Examiner* — Devon Kramer
*Assistant Examiner* — Christopher Brunjes
(74) *Attorney, Agent, or Firm* — Sughrue Mion, PLLC

(57) ABSTRACT

An electric compressor to be mounted on an engine in an engine compartment of a vehicle includes a compression mechanism, an electric motor, a motor driving circuit, a housing, a first mounting leg and a second mounting leg. The housing accommodates therein the compression mechanism, the electric motor and the motor driving circuit. The first mounting leg projects from the housing at a position adjacent to the compression mechanism. The second mounting leg projects from the housing at a position adjacent to the motor driving circuit. Each of the first mounting leg and the second mounting leg includes a fastening portion to be fastened to a portion of the engine and a connecting portion that connects the fastening portion with the housing. The connecting portion of the first mounting leg is made to be broken more easily than connecting portion of the second mounting leg.

4 Claims, 2 Drawing Sheets

(51) Int. Cl.

| | |
|---|---|
| ***F04B 39/12*** | (2006.01) |
| ***F04B 35/04*** | (2006.01) |
| ***F04C 23/00*** | (2006.01) |
| ***F04C 28/28*** | (2006.01) |
| ***F04C 18/02*** | (2006.01) |

(52) U.S. Cl.
CPC ..... *F04C 18/0215* (2013.01); *F04C 23/008* (2013.01); *F04C 28/28* (2013.01); *F04C 2240/805* (2013.01); *F04C 2240/808* (2013.01); *Y10S 248/909* (2013.01)

(58) Field of Classification Search
CPC F04C 28/28; F04C 18/0215; F04C 2240/808; F04C 2240/805; Y10S 248/909
USPC ..... 417/410.5, 360; 248/548, 909, 638, 674
See application file for complete search history.

(56) References Cited

U.S. PATENT DOCUMENTS

| | | | | |
|---|---|---|---|---|
| 2011/0243771 | A1 | 10/2011 | Kinoshita et al. | |
| 2012/0183422 | A1* | 7/2012 | Bahmata ..... | H02K 1/185 417/423.15 |
| 2014/0003973 | A1* | 1/2014 | Arai ..... | F04D 29/4206 417/363 |

FOREIGN PATENT DOCUMENTS

| | | | |
|---|---|---|---|
| JP | 2009-103100 | A | 5/2009 |
| JP | 2010-158991 | A | 7/2010 |
| JP | 2011-208619 | A | 10/2011 |

* cited by examiner

ELECTRIC COMPRESSOR FOR VEHICLE AIR CONDITIONER

BACKGROUND OF THE INVENTION

The present invention relates to an electric compressor for vehicle air conditioner.

Japanese Patent Application Publication No. 2004-32494 discloses an electric compressor used for a vehicle air conditioner. This type of compressor has a housing that is formed with a plurality of mounting legs projecting from the housing. Each mounting leg includes a fastening portion to which a corresponding portion of an engine is fastened and a connecting portion which connects the fastening portion to the housing. The electric compressor is mounted on the engine in an engine compartment of the vehicle by fastening the fastening portions to the respective portion of the engine.

If any external force is applied to the vehicle and the electric compressor is moved in the engine compartment by receiving force transmitted from the vehicle, the compressor may collide against objects therearound such as an auxiliary machine and be damaged at the housing which accommodates a motor driving circuit, and the force may be transmitted to the motor driving circuit.

The present invention, which has been made in view of the above problem, is directed to providing an electric compressor for vehicle air conditioner, wherein an external force transmitted to the motor driving circuit is suppressed.

SUMMARY OF THE INVENTION

In accordance with an aspect of the present invention, there is provided an electric compressor to be mounted on an engine in an engine compartment of a vehicle. The electric compressor includes a compression mechanism, an electric motor, a motor driving circuit, a housing, a first mounting leg and a second mounting leg. The compression mechanism is provided for compressing refrigerant. The electric motor is provided for driving the compression mechanism. The motor driving circuit is provided for driving the electric motor. The housing accommodates therein the compression mechanism, the electric motor and the motor driving circuit. The first mounting leg projects from the housing at a position that is adjacent to the compression mechanism. The second mounting leg projects from the housing at a position that is adjacent to the motor driving circuit. Each of the first mounting leg and the second mounting leg includes a fastening portion to be fastened to a portion of the engine and a connecting portion that connects the fastening portion with the housing. The connecting portion of the first mounting leg is made to be broken more easily than connecting portion of the second mounting leg.

Other aspects and advantages of the invention will become apparent from the following description, taken in conjunction with the accompanying drawings, illustrating by way of example the principles of the invention.

BRIEF DESCRIPTION OF THE DRAWINGS

The invention together with objects and advantages thereof, may best be understood by reference to the following description of the presently preferred embodiments together with the accompanying drawings in which.

DETAILED DESCRIPTION OF THE EMBODIMENTS

Figure 1A:
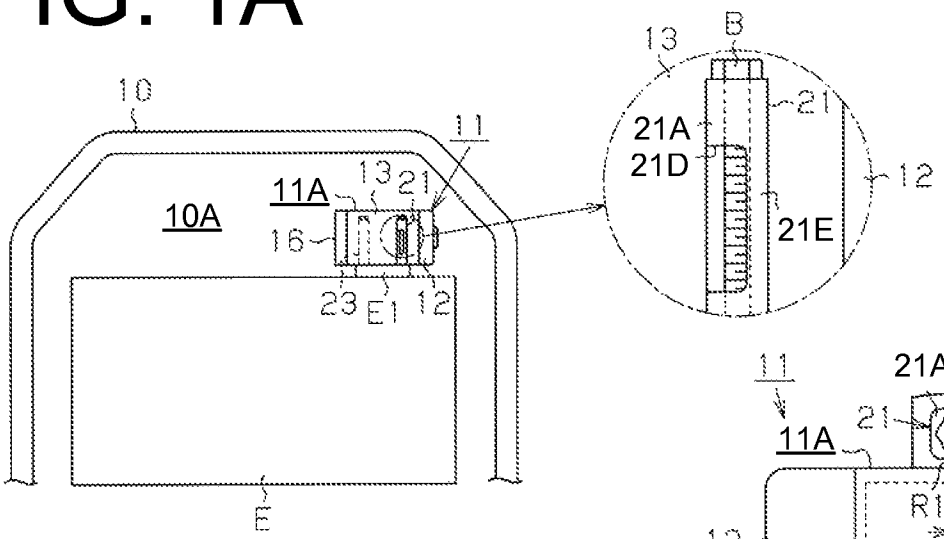
FIG. 1A is a schematic diagram showing an electric compressor in an engine compartment of a vehicle according to an embodiment of the invention.

The following will describe an embodiment of the present invention with reference to FIG. 1A to FIG. 3. Referring to FIG. 1A, numeral 10 designates a vehicle having therein an engine compartment 10A and an engine E is disposed in the engine compartment 10A. The engine E has a block E1 and an electric compressor 11 is fixed or fastened to the block E1. Thus, the block E1 serves as the portion of the engine E to which the electric compressor 11 is fastened.

Figure 1B:
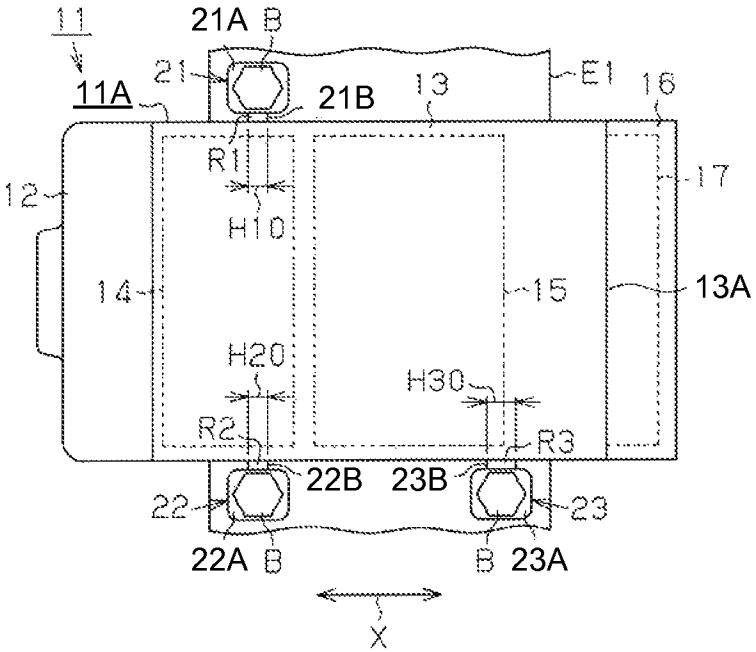
FIG. 1B is a side schematic view of the electric compressor of FIG. 1A.

As shown in FIG. 1B, the electric compressor 11 has a housing 11A that includes a cylindrical discharge housing 12, a cylindrical suction housing 13 and a cylindrical cover 16, each of which has a closed end. The suction housing 13 is connected to the discharge housing 12 and the cover 16 is mounted on a bottom wall 13A of the suction housing 13. The discharge housing 12, the suction housing 13 and the cover 16 are made of aluminum (metal material). The suction housing 13 accommodates therein a compression mechanism 14 that compresses a refrigerant gas and an electric motor 15 that drives the compression mechanism 14. Although an illustration is omitted in the drawing, the compression mechanism 14 of the electric compressor 11 according to the present embodiment includes a fixed scroll which is fixed in the suction housing 13 and a movable scroll which is disposed in facing relation to the fixed scroll.

A motor driving circuit 17 that drives the electric motor 15 is provided between the bottom wall 13A of the suction housing 13 and the cover 16. According to the present embodiment, the compression mechanism 14, the electric motor 15 and the motor driving circuit 17 are arranged in this order along the axial direction of the housing 11A that is indicated by double-headed arrow X.

First mounting legs 21, 22 and a second mounting leg 23 are formed projecting from the suction housing 13. The first mounting legs 21, 22 and the second mounting leg 23 are formed integrally with the suction housing 13 and used to mount the electric compressor 11 to the block E1. The mounting legs 21, 22, 23 include fastening portions 21A, 22A, 23A, respectively, and a bolt B is inserted in each of the fastening portions 21A, 22A, 23A. The mounting legs 21, 22, 23 further include connecting portions 21B, 22B, 23B that connect the fastening portions 21A, 22A, 23A to the suction housing 13, respectively.

The first mounting legs 21, 22 are disposed on the outer peripheral surface at opposite sides of the suction housing 13 with respect to the longitudinal axis of the suction housing 13. The first mounting legs 21, 22 are formed at positions that are close to the discharge housing 12 (or the compression mechanism 14). The second mounting leg 23 is formed at a position on the outer peripheral surface of the suction housing 13 that is closer to the cover 16 (or the motor driving circuit 17). The fastening portions 21A, 22A, 23A of the first and second mounting legs 21, 22, 23 extend parallel to each other and orthogonally to the axial direction of the housing 11A.

The bolts B are inserted into the fastening portions 21A, 22A, 23A and are screwed into the block E1, so that the fastening portion 21A, 22A, 23A are fastened to the block E1. According to the present embodiment, the electric compressor 11 is mounted on the engine E in such way that the discharge housing 12 of the electric compressor 11 is located closer to the outside of the engine compartment 10A than the cover 16. Consequently, the electric compressor 11 is mounted on the engine E in such an orientation that the first mounting legs 21, 22 are located at the position closer to the outside of the engine compartment 10A than the second mounting leg 23.

Figure 2A:
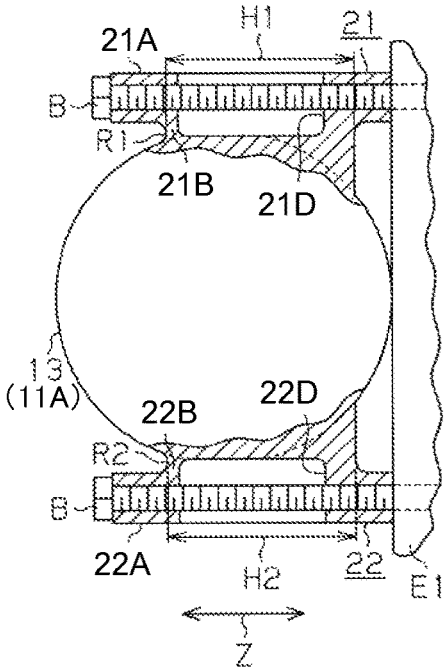
FIGS. 2A and 2B are partial cross-section views of the electric compressor of FIG. 1A.

As shown in FIG. 2A, the dimensions H1, H2 of the respective connecting portions 21B, 22B as measured in the extending direction thereof indicated by double-headed arrow Z in FIG. 2A are substantially the same. Specifically, the surfaces R1, R2 connecting the outer peripheral surfaces of the suction housing 13 and the respective fastening portions 21A, 22A sequentially are cut so as to be recessed in the extending direction of the connecting portions 21B, 22B so that the dimension H1, H2 are substantially the same.

Figure 2B:
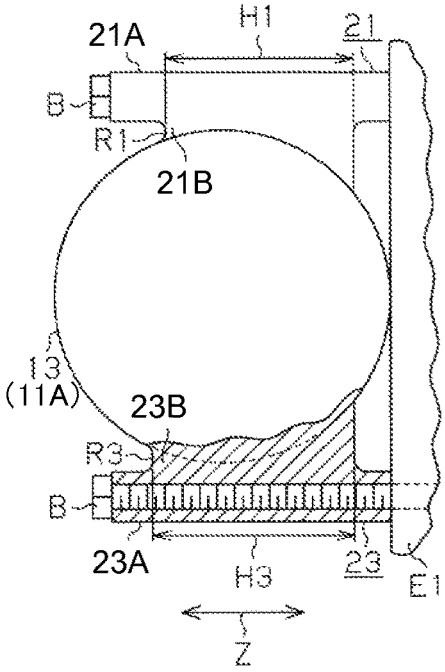

As shown in FIG. 2B, the dimensions H1, H2 of the connecting portions 21B, 22B are smaller than the dimension H3 of the connecting portion 23B of the second mounting leg 23 as measured in the extending direction thereof. Specifically, the surfaces R1, R2 are cut deeper in the extending direction than the surface R3 that connects the outer periphery surfaces of connecting portion 23A and the suction housing 13.

As shown in FIG. 1B, the dimensions H10, H20 of the connecting portions 21B, 22B as measured in the axial direction of the housing 11A are substantially the same. Meanwhile, the dimensions H10, H20 are smaller than the dimension H30 of the connecting portion 23B of the second mounting leg 23 as measured in the axial direction.

Figure 3:
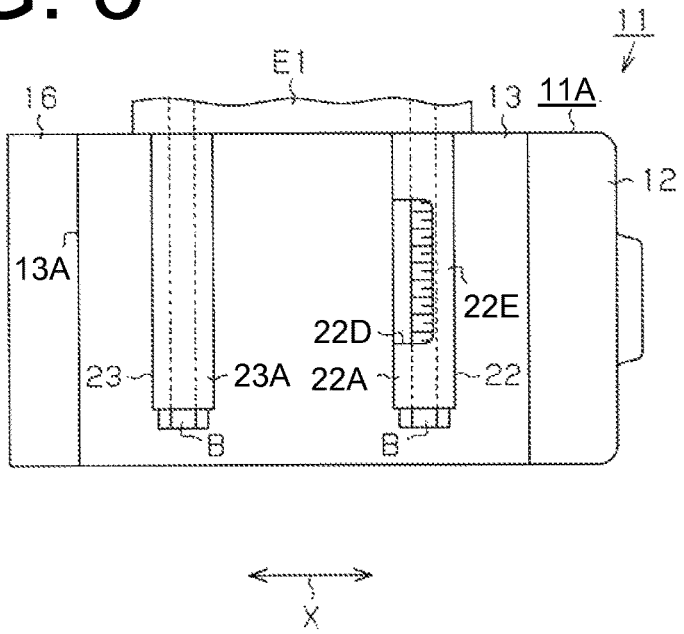
FIG. 3 is a bottom view of the electric compressor for vehicle of FIG. 1A.

As shown in FIG. 2A, thickness removing portions 21D, 22D in the form of a hole are formed in the fastening portion 21A, 22A and the connecting portion 21B and 22B. As shown in FIGS. 1A and 3, linking portions 21E, 22E are formed in the fastening portions 21A, 22A of the mounting legs 21, 22 to connect the opposite axial ends of the fastening portions 21A, 22A, respectively.

The following will describe the operation of the compressor according to the embodiment of the present invention. The first mounting legs 21, 22 that are located closer to the outside of the engine compartment 10A are more likely to receive load from the external force applied to the vehicle 10 than the second mounting leg 23. In the electric compressor 11 of the present embodiment, the dimensions H1, H2 of the connecting portions 21B, 22B of first mounting legs 21, 22 are smaller in the extending direction than the dimension H3 of the connecting portion 23B of the second mounting leg 23. In addition, the dimensions H10, H20 of the connecting portions 21B, 22B of the first mounting legs 21, 22 are smaller in the axial direction of the housing 11A than the dimension H30 of the connecting portion 23B of the second mounting leg 23. Therefore, the rigidity of the connecting portions 21B, 22B of the first mounting legs 21, 22 is lower than that of the connecting portion 23B of the second mounting leg 23.

In the electric compressor 11 of the present embodiment, if any external force applied to the vehicle 10 is transmitted to the housing 11A and the connecting portions 21B, 22B of the first mounting legs 21, 22 are broken, the force transmitted from the housing 11A to the second mounting leg 23 is suppressed. Thus, the connecting portion 23B is hard to be broken and the movement of the electric compressor 11 in the engine compartment 10A is restricted. This prevents the electric compressor 11 from colliding against objects therearound such as an auxiliary machine in the engine compartment 10A, so that the housing 11A accommodating therein the motor driving circuit 17 is protected against a damage. As a result, the transmission of external force to the motor driving circuit 17 can be suppressed.

Furthermore, the thickness removing portions 21D, 22D are formed in the connecting portions 21B, 22B of the first mounting legs 21, 22. With this configuration, the connecting portions 21B, 22B of the first mounting legs 21, 22 have rigidity lower than the connection portion 23B of the second mounting leg 23. That is, the rigidity of the connecting portions 21B, 22B of the first mounting legs 21, 22 are reduced partially. Accordingly, the connecting portions 21B, 22B are formed so as to be broken more easily than the connecting portion 23B when any external force is applied to the vehicle 10.

The above-described embodiment of the present invention offers the following effects.

(1) The connecting portions 21B, 22B of the first mounting legs 21, 22 are made so as to be broken more easily than the connecting portion 23B of the second mounting leg 23. Thus, when the external force applied to the vehicle 10 is transmitted to the housing 11A, the connecting portions 21B, 22B of the first mounting legs 21, 22 that are close to the compression mechanism 14 are broken to suppress the transmission of the external force to the connecting portion 23B of the second mounting leg 23. Consequently, the connecting portion 23B becomes hard to be broken and the movement of the electric compressor 11 in the engine compartment 10A can be restricted. Therefore, damage to the housing 11A accommodating therein the motor driving circuit 17, that is caused by collision of the electric compressor 11 against objects therearound such as an auxiliary machine in the engine compartment 10A, is prevented, and the transmission of the external force to the motor driving circuit 17 is suppressed.

(2) The thickness removing portions 21D, 22D are formed in the connecting portions 21B, 22B of the first mounting leg 21, 22. This enables the connecting portions 21B, 22B to break easily by the external force applied to vehicle 10.

(3) The dimensions H1, H2 of the connecting portions 21B, 22B of the first mounting legs 21, 22 are smaller in the extending direction than the dimension H3 of the connecting portion 23B of the second mounting leg 23. Moreover, the dimensions H10, H20 of the first mounting legs 21, 22 are smaller in the axial direction of the housing 11A than the dimension H30 of the connecting portion 23B of the second mounting leg 23. Therefore, the rigidity of connecting portions 21B and 22B of the first mounting legs 21, 22 is lower than that of the connecting portion 23B of the second mounting leg 23. That is that the connecting portion 23B is harder to be broken than the connecting portion 21B, 22B.

(4) The provision of the thickness removing portions 21D, 22D in the first mounting legs 21, 22 makes the weight of the electric compressor 11 lighter as compared with a case in which no such thickness removing portion is formed.

(5) The linking portions 21E, 22E are formed in the fastening portions 21A, 22A of the mounting legs 21, 22 to connect the opposite axial ends of the fastening portions 21A, 22A, respectively, despite the thickness removing portions 21D, 22D of the first mounting legs 21, 22. Therefore, when the first mounting legs 21, 22 and the block E1 are fastened with the bolts B, the fastening portions 21A and 22A are prevented from bending in the axial direction thereof.

The above-described embodiment may be modified in various ways as exemplified below. The linking portions 21E, 22E of the fastening portions 21A, 22A may be dispensed with. In this case, the opposite axial ends of the fastening portions 21A, 22A may be joined only by the connecting portions 21B, 22B.

The formation of the thickness removing portions 21D, 22D in the first mounting legs 21, 22 may be omitted.

The dimensions H10, H20 of the connecting portions 21B, 22B of the first mounting legs 21, 22 may be the same in the axial direction of the housing 11A as the dimension H30 of the connecting portion 23B of the second mounting leg 23.

The embodiment may be modified so that the dimensions H1, H2, H3 of the connecting portions 21B, 22B, 23B of the first and second mounting legs 21, 22, 23 in the extending direction are the same.

In the embodiment, the first mounting legs 21, 22 may be disposed at positions shifted from the positions shown in FIG. 2A in the axial direction of housing 11A.

In the embodiment, the connecting portions 21B, 22B of the first mounting legs 21, 22 may be made of a material whose rigidity is lower than that of the connecting portions 23B of the second mounting leg 23.

The electric compressor 11 may not be fixed to the engine E by fastening the fastening portions 21A, 22A, 23A to the block E1 with the bolts B. Alternatively, the fastening portions 21A, 22A, 23A may be welded to the block E1.

According to the present invention, the number of mounting legs is not specifically limited to two first mounting legs such as 21, 22 and one second mounting leg such as 23.

According to the present invention, the position of the electric compressor 11 in the engine compartment 10A is not specifically limited. However, it is desirable that the electric compressor 11 should be mounted on the engine E so that the discharge housing 12 of the electric compressor 11 is located at a position that is closer to the outside of the engine compartment 10A than the cover 16.

According to the present invention, the motor driving circuit 17 may be provided in the suction housing 13 at a position that is radially outward and close to the second mounting leg 23.

According to the present embodiment, the compression mechanism 14 is of a scroll type, however it is not limited thereto. Alternatively, the compression mechanism may be piston type or vane type.

What is claimed is:

1. An electric compressor configured to be mounted on an engine in an engine compartment of a vehicle, comprising:

a compression mechanism for compressing refrigerant;

an electric motor for driving the compression mechanism;

a motor driving circuit for driving the electric motor;

a housing accommodating therein the compression mechanism, the electric motor and the motor driving circuit, wherein the compression mechanism, the electric motor and the motor driving circuit are arranged in this order along an axial direction of the housing;

at least three mounting legs projecting from the housing, the at least three mounting legs including:

a first mounting leg projecting from the housing at a position that is close to the compression mechanism; and a second mounting leg projecting from the housing at a position that is disposed at a radially outer side of the electric motor and that is closest to the motor driving circuit amongst the at least three mounting legs, wherein each of the first mounting leg and the second mounting leg includes a fastening portion configured to be fastened to the engine and a connecting portion which connects the fastening portion with the housing, wherein the connecting portion is disposed closer to the housing than the fastening portion to the housing;

wherein the connecting portion of the first mounting leg is configured to be broken more easily than the connecting portion of the second mounting leg so that the connecting portion of the first mounting leg that is close to the compression mechanism suppresses the transmission of the external force to the connecting portion of the second mounting leg when external force applied to the vehicle is transmitted to the housing, wherein a thickness removing portion is formed in the fastening portion and the connecting portion of the first mounting leg without being formed in the second mounting leg, so that the connecting portion of the first mounting leg has a lower rigidity than the connecting portion of the second mounting leg.

2. The electric compressor according to claim 1, wherein a linking portion is formed in the fastening portion to connect opposite axial ends of the fastening portion.

3. An electric compressor configured to be mounted on an engine in an engine compartment of a vehicle, comprising:

a compression mechanism for compressing refrigerant;

an electric motor for driving the compression mechanism;

a motor driving circuit for driving the electric motor;

a housing accommodating therein the compression mechanism, the electric motor and the motor driving circuit, wherein the compression mechanism, the electric motor and the motor driving circuit are arranged in this order along an axial direction of the housing;

at least three mounting legs projecting from the housing, the at least three mounting legs including:

a first mounting leg projecting from the housing at a position that is close to the compression mechanism; and a second mounting leg projecting from the housing at a position that is disposed at a radially outer side of the electric motor and that is closest to the motor driving circuit amongst the at least three mounting legs;

wherein each of the first mounting leg and the second mounting leg includes a fastening portion configured to be fastened to the engine by a first bolt and a second bolt, respectively, and a connecting portion which connects the fastening portion with the housing;

wherein the connecting portion of the first mounting leg is configured to be broken more easily than the connecting portion of the second mounting leg so that the connecting portion of the first mounting leg that is close to the compression mechanism suppresses the transmission of the external force to the connecting portion of the second mounting leg when external force applied to the vehicle is transmitted to the housing, wherein a dimension of the connecting portion of the first mounting leg as measured in a longitudinal direction of the first bolt is smaller than a dimension of the connecting portion of the second mounting leg as measured in extending longitudinal direction of the second bolt.

4. An electric compressor configured to be mounted on an engine in an engine compartment of a vehicle, comprising:

a compression mechanism for compressing refrigerant;

an electric motor for driving the compression mechanism;

a motor driving circuit for driving the electric motor;

a housing accommodating therein the compression mechanism, the electric motor and the motor driving circuit, wherein the compression mechanism, the electric motor and the motor driving circuit are arranged in this order along an axial direction of the housing;

at least three mounting legs projecting from the housing, the at least three mounting legs including:

a first mounting leg projecting from the housing at a position that is close to the compression mechanism; and a second mounting leg projecting from the housing at a position that is disposed at a radially outer side of the electric motor and that is closest to the motor driving circuit amongst the at least three mounting legs, wherein each of the first mounting leg and the second mounting leg includes a fastening portion configured to be fastened to the engine, and a connecting portion which connects the fastening portion with the housing;

wherein the connecting portion of the first mounting leg is configured to be broken more easily than the connecting portion of the second mounting leg so that the connecting portion of the first mounting leg that is close to the compression mechanism suppresses the transmission of the external force to the connecting portion of the second mounting leg when external force applied to the vehicle is transmitted to the housing, wherein a dimension of the connecting portion of the first mounting leg as measured in an axial direction of the housing is smaller than a dimension of the connecting portion of the second mounting leg as measured in the axial direction of the housing.

* * * * *